United States Patent [19]

Joyal et al.

[11] 4,321,568

[45] Mar. 23, 1982

[54] WAVEGUIDE FILTER EMPLOYING COMMON PHASE PLANE COUPLING

[75] Inventors: Francis G. Joyal, Groveland; Chung-Li Ren, Andover, both of Mass.

[73] Assignee: Bell Telephone Laboratories, Incorporated, Murray Hill, N.J.

[21] Appl. No.: 188,904

[22] Filed: Sep. 19, 1980

[51] Int. Cl.[3] ..... H01P 1/208; H01P 1/209; H01P 7/10; H01P 7/06

[52] U.S. Cl. ..... 333/209; 333/202; 333/232; 333/235

[58] Field of Search ..... 333/202, 208–212, 333/219, 222–235

[56] References Cited

U.S. PATENT DOCUMENTS

| | | | |
|---|---|---|---|
| 3,579,153 | 5/1971 | Wang | 332/209 |
| 3,748,604 | 7/1973 | Wang | 333/208 X |
| 4,096,457 | 6/1978 | Snyder | 333/210 X |
| 4,124,830 | 11/1978 | Ren | 333/232 X |
| 4,251,787 | 2/1981 | Young et al. | 333/209 |

*Primary Examiner*—Marvin L. Nussbaum
*Attorney, Agent, or Firm*—John Francis Moran

[57] ABSTRACT

Bandstop (FIGS. 1–3) and bandpass (FIGS. 4, 5) filters are presented utilizing broad and narrow wall resonator coupling in a rectangular waveguide (11 and 37) at a common cross sectional reference plane. For the bandstop filter, the resonators (12, 13) are resonant at a common frequency $f_0$ to provide a two-pole bandstop response in a filter of minimal longitudinal dimensions. For the compact bandpass filter, each tone rejection is provided by a pair of resonators (31, 35) coupling to the electromagnetic field signal at two points one from a broad wall and the other from a narrow wall of the waveguide (37) but displaced by some multiple of a half wavelength. Another pair of resonators (33, 34) are in common cross sectional plane relationship to the first pair but located on a wall of different width to provide rejection of a tone at the other end of the passband. The use of resonators with different resonant frequencies at a common cross sectional plane avoids possible interresonator coupling. Additional pairs of resonators (e.g., 32, 36) may be interleaved with these resonator locations. Each resonator (e.g., 13) is associated with an aperture (e.g., 19) and has its major portion extending into a housing (e.g., 18) located exterior to the waveguide (e.g., 11).

17 Claims, 7 Drawing Figures

WAVEGUIDE FILTER EMPLOYING COMMON PHASE PLANE COUPLING

BACKGROUND OF THE INVENTION

This invention relates to microwave filters and, in particular, to waveguide filters employing dielectric resonators.

Practical mounting elements for dielectric resonators in conventional bandstop filters are available. See, for example, U.S. Pat. No. 4,124,830 issued to C. Ren on Nov. 7, 1978. The physical size, namely the length of this type of filters, as well as the other types of waveguide filters is related to the wavelength of the propagating electromagnetic field therein. Particularly in the case of multiple tone or bandstop filters, the longitudinal dimensions of conventionally designed filters increases when multiple tuned elements are used. Due to practical considerations, the tuned elements must be spaced at appropriate intervals to achieve rejection at desired attenuation levels. In particular, multiple pole filtering characteristics typically requires the cooperation of a plurality of resonators working at peak efficiency to achieve a desired response as depicted by the shape of the attenuation curve in the bandstop region.

SUMMARY OF THE INVENTION

The present invention is a rectangular waveguide band rejection filter employing dual dielectric resonator coupling to the applied electromagnetic energy at the same cross section of the waveguide. One is located in an aperture in the broad wall, and the other is similarly located in the narrow wall of the waveguide. By virtue of the aperture locations, the pair of resonators are coupled to the propagating electromagnetic energy at a prescribed phase relationship thereby minimizing the longitudinal dimensions of the filter. The use of resonators having different resonant frequencies in each pair extends the basic arrangement to provide multiple tone rejection while preventing possible interresonator coupling. A reversal of the positions of the dielectric resonators with the same frequency vis-a-vis each pair in the extended arrangement serves again to reduce the required longitudinal spacing between the two pair and hence the overall length of the filter.

DETAILED DESCRIPTION

Figure 1:
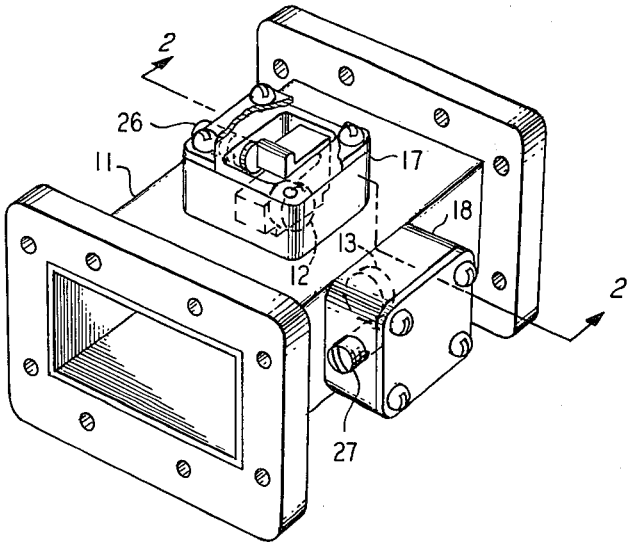
FIG. 1 is a perspective view of a filter employing the basic invention principles.
Figure 2:
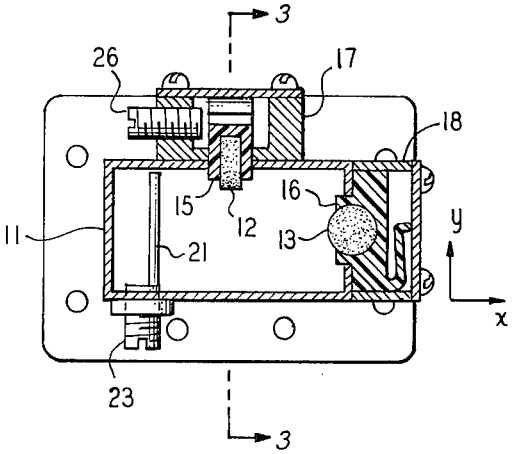
FIG. 2 is a sectional view of FIG. 1 clearly illustrating the two resonators located at the same cross section of the waveguide.
Figure 3:
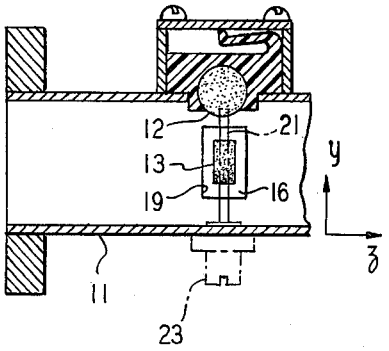
FIG. 3 is a sectional view further illustrating the relationship of the two resonators in FIG. 2.

Three views of a ceramic resonator waveguide band stop filter employing the basic principles of the present invention are shown in FIGS. 1, 2 and 3. With reference to FIGS. 1, 2 and 3, waveguide 11 has disposed therein at the same cross section of the waveguide circular disc ceramic dielectric resonators 12 and 13, respectively, located in the broad wall and narrow wall of the waveguide. Both ceramic resonators 12 and 13 are mounted at the same cross section as illustrated most clearly in FIG. 2. Furthermore, resonators 12 and 13 only partially extend into waveguide 11 with their remaining substantial portions respectively positioned by mounting fixtures 15 and 16 centrally within respective metallic housings 17 and 18. Resonator 13 as shown in FIG. 3 partially extends into waveguide 11 through aperture 19 and similarly resonator 12 also extends through an aperture of the same size but in the broad wall. Both resonators 12 and 13 have a resonant frequency $f_0$ to provide a measurable insertion loss for band rejection between the input and output ports at the frequency $f_0$.

In accordance with the present invention, when an electromagnetic wave is propagating through waveguide 11, a coupling arrangement exists between resonator 12 and the transverse magnetic field $H_x$ in the dominant mode of the propagating wave. Concurrently at the same cross section or same phase plane, resonator 13 couples to the longitudinal magnetic field of the dominant mode in waveguide 11, $H_z$. Thus, the electromagnetic field at the waveguide walls is coupled to each resonator which induces a resonant mode $H_{011}$ therein at frequency $f_0$. The resonant frequency $f_0$ for each ceramic dielectric resonator is determined by the dielectric constant of the ceramic material, the diameter of the resonator disc and the length, or thickness, of the disc. Due to the physical location of the resonators, a desirable 90 degree electrical phase angle exists between the resonators at the two coupling points although located at the same cross section which provides for maximum combined effectiveness of the two resonators with the electromagnetic energy in the waveguide.

Suitable dielectric material for these resonators is barium titanate, $Ba_2Ti_9O_{20}$, having appropriate dimensions in order to insure that the principle resonant mode induced is the lowest order circular electric mode $H_{011}$. Barium titanate also provides good temperature stability for minimal frequency drift. In addition, to limit the resonance to this desired circular mode and to avoid spurious mode excitation, the planar surfaces of resonators 12 and 13 each are disposed perpendicular to the coupling magnetic field ($H_x$ and $H_z$ respectively), and the center of resonator 12 is positioned along the center line of the broad waveguide wall where the strength of the uncoupled magnetic field $H_z$ is nill.

Housings 17 and 18 serve to isolate resonators 12 and 13 further from each other and thus minimize interresonator coupling, to reduce resonator perturbation of the waveguide, and to provide shielding. Since the induced current on the wall surfaces of the housing contribute to filter loss, the size of the housing is made sufficiently large so long as no propagating waveguide modes are generated. Additional isolation between the housing and the main waveguide cavity is also obtained by minimizing the dimensions of the aperture.

Mounting fixtures 15 and 16 are made of a dielectric material having a low dielectric constant and a low loss tangent factor. To minimize filter loss the mounting fixture is designed with minimum use of mounting material. In addition, the presence of mounting material near or at the electromagnetic field of coupling should be minimal or if possible avoided. Styrene-Phenylene-Oxide molding compound, known commercially as NORYL, is the preferred material for use as the mounting fixture since its ability to be molded lowers production costs. Alternative materials, such as rexolite and fused quartz, have the cost disadvantage of requiring machine fabrication.

An asymmetrical frequency response of the $H_x$ coupled resonator 12 exists using this coupling structure which is corrected by locating a tunable shunt inductive element in the waveguide cavity proximate to resonator 12. In particular, shunt inductive metal post 21 is located near resonator 12 and at the same cross section as resonators 12 and resonator 13. Shunt inductive metal post 21 provides a tunable inductance which is a function of the post diameter and its location relative to the side wall of the waveguide. Tuning post 21 is perpendicularly mounted on adjustment screw 23 so that the axis of post 21 is noncoincident with or offset from the screw axis. Tuning is accomplished by turning screw 23 to vary the location of post 21 within the waveguide to provide a symmetrical band reject response characteristic and to obtain a good match for the passband of the filter. Tuning post 21 and screw 23 are shown in phantom in FIG. 3 to provide a clear indication of their physical location since they actually fall into the removed portion of FIG. 3.

As mentioned in the foregoing, the resonant frequency $f_0$ of dielectric resonators 12 and 13 is a function of the dielectric constant of the ceramic material and the physical dimensions of the disc. Although these parameters could be manufactured within a tight tolerance to meet design specifications so that frequency tuning would be unnecessary, such a manufacturing process would be economically impractical. Accordingly, it should be pointed out that tuning screws 26 and 27 are located respectively in a side wall of each of cavities 17 and 18. The axial orientation of each screw corresponds to the cylindrical axial orientation of the resonant disc located in that cavity. Therefore the resonant frequency of resonator 12 is varied by adjusting the position of screw 26 which extends into housing 17. In addition, by aligning the axis of screw 26 with the cylindrical axis of resonator disc 12, the excitation of spurious resonant modes in the dielectric resonator within the operating band can be avoided. A sufficiently large tuning range is obtained by using a screw having a large diameter. The resonant frequency of resonator 13 is similarly varied by adjusting screw 27 associated with housing 18.

Figure 4:
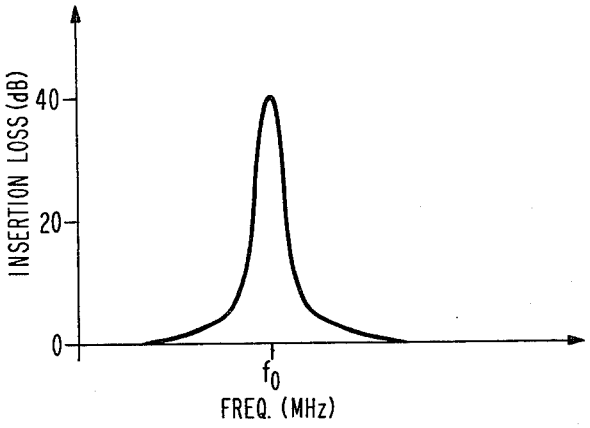
FIG. 4 illustrates the insertion loss obtained for a filter of the type shown in FIGS. 1 through 3.

FIG. 4 illustrates the characteristic of the measured insertion loss versus frequency for the filter illustrated in FIGS. 1, 2 and 3. In this case, the filter was designed for the 6 GHz range with a single bandstop region. However, the use of resonators of different frequency may be readily utilized to provide other responses.

Figure 5:
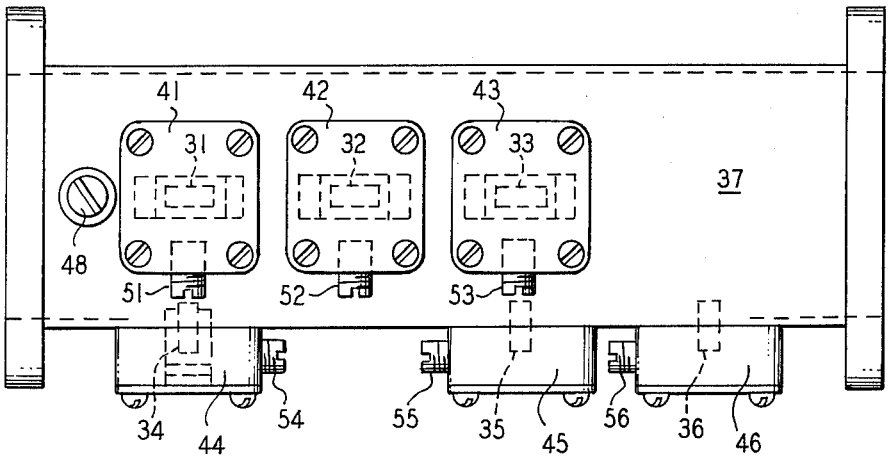
FIG. 5 is a top view of an embodiment of a multiple tone rejection filter utilizing the inventive principles.
Figure 6:
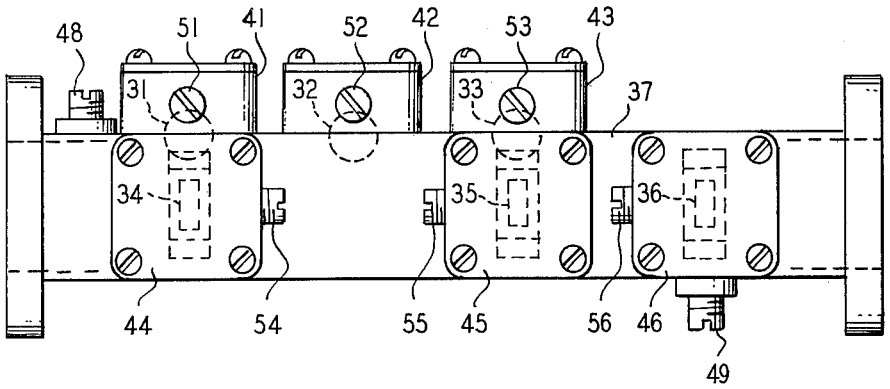
FIG. 6 is a side view of the filter of FIG. 5.

FIGS. 5 and 6 are two views of a three-tone band rejection filter employing multiple locations in both the narrow wall and broad wall to provide a filter of considerably contracted length. In particular, the filter of FIGS. 5 and 6 may be designed to pass a signal band centered at frequency $f_c$ by rejecting two tones $f_1$ and $f_2$ plus or minus $\Delta f$ from $f_c$ and third tone $f_3$ at either plus or minus $\Delta f'$ from $f_c$. Each tone rejection is provided again by a pair of dielectric resonators, one located at an aperture in a narrow wall and one located at an aperture in a broad wall, but spaced at longitudinally disposed locations afforded by an extension of the inventive principles.

FIG. 5 is a top view of a tone rejection filter employing six dielectric resonators 31–36 at predetermined locations in waveguide 37 each with its own housing 41–46 exterior to the waveguide and each respective housing includes one of tuning screws 51–56. These same elements are also shown in FIG. 6 as waveguide 37 is viewed from the side instead of from the top as in FIG. 5. The spacing of dielectric resonator pairs at the same frequency is at a multiple of a half wavelength interval ($n\lambda_c/2$ where $n=1,2,3 \ldots$,) at the channel or passband frequency $f_c$. In particular, resonators 34 and 33 are resonant at frequency $f_1$ to provide tone rejection, or insertion loss, at that frequency. Since resonator 34 is located in the narrow wall, while resonator 33 is located in the broad wall, the spacing between the two need only correspond to a multiple of a half wavelength since an additional electrical phase displacement of a quarter wavelength is provided by placing the two resonators on walls of different width. Hence the total phase displacement between the two resonators is an odd multiple of a quarter wavelength for maximum combined effectiveness. Correspondingly, resonators 31 and 35 are located on different walls and have the same spacing between them to provide tone rejection at frequency $f_2$ thereby completing the complementary resonator locations for the dual tone rejection. In this case, the two resonators located at a common cross section of the waveguide have different resonant frequencies thereby minimizing possible interresonator coupling.

Tone rejection at frequency $f_3$ is accomplished by remaining resonators 32 and 36, which are located to straddle, or interleave, the common cross sectional locations of resonators 33 and 35. The longitudinal spacing between resonators 32 and 36 corresponds to a multiple of a half wavelength at frequency $f_3$. It should be pointed out that in this case there is a possibility of interresonator coupling along the narrow wall, such as between resonators 35 and 36. This effect is minimized by choosing the resonant frequencies of resonators in physically close proximity to be electrically far apart in accordance with the specific tone rejection frequencies for which the filter is designed to provide.

Figure 7:
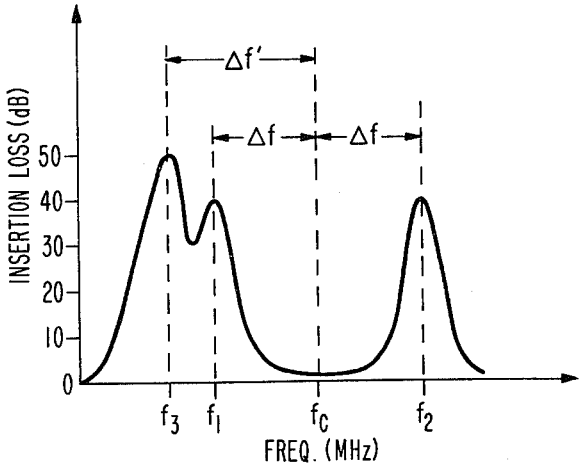
FIG. 7 depicts measured insertion loss for the type of filter shown in FIGS. 5 and 6.

FIG. 7 depicts the measured insertion loss for the filter configuration described in connection with FIGS. 5 and 6. This particular design has a channel frequency $f_c$ of six GHz. As may be observed, high insertion loss corresponds to the tone rejection at frequencies $f_1$ and $f_2$ symmetrical about either side of the channel frequency $f_c$. High insertion loss also occurs at frequency $f_3$ which is below frequency $f_1$.

A slightly different characteristic for the same filter structure may be achieved when frequency $f_3$ is above frequency $f_2$. In this case, resonators 31 and 35 form the first pair to provide tone rejection at frequency $f_1$. The second resonator pair includes resonators 33 and 34 to provide tone rejection at frequency $f_2$ while the remaining resonators 32 and 36 provide tone rejection at frequency $f_3$. This particular arrangement also provides minimal interresonator coupling by using resonators of different frequency at the two common cross sectional locations and resonators of the greatest frequency difference for locations in proximity at the narrow wall.

In addition to switching the locations of resonators with different frequencies, alternative physical structural combinations are possible utilizing the underlying inventive principles. For example, the location of resonator 36 may be switched to the other narrow wall of waveguide 37 and still provide the same electrical characteristics. Also the location of resonator 32 may be moved to the other broad wall to provide the same operation for either of the two locations of resonator 36. It should also be pointed out that tuning posts 48 and 49 are located in FIGS. 5 and 6 to provide adjustment of the overall symmetry of the resonators response with respect to $f_c$. Also, the employment of tuning screws 51–56 provides fine tuning of each one of their respective resonators and allows all the housings to have a common design.

Various modifications of the filters presented herein may be made without departing from the foregoing inventive principles. For example, although a three-tone, two-pole per tone filter embodiment is presented herein, additional dielectric resonators may be utilized to provide further tone rejection frequencies and other than two-pole per tone and still achieve filter designs of contracted lengths. Also, the locations and number of tuning posts being utilized may be readily changed to increase their effectiveness for the particular operational frequency of a filter design. Although the spacing between cooperating pairs of resonators having corresponding resonant frequencies herein was expressed in terms of fractional wavelength values of the nominal $f_c$, further effectiveness may be achieved when such spacing is related to the actual tone rejection frequencies, i.e., $f_1$, $f_2$, $f_3$, etc. Accordingly modifications, as mentioned in the foregoing, are merely illustrative of the numerous and varied others that may be devised by those skilled in the art without departing from the spirit and scope of the invention.

We claim:

1. A waveguide filter (FIG. 1 or FIG. 5) comprising a rectangular waveguide (11 or 37) having two broad width and two narrow width waveguide walls and capable of propagating electromagnetic energy therethrough, a plurality of resonators (12, 13 or 31, 34) each associated with an aperture being located in a waveguide wall for coupling electromagnetic energy to each resonator by partially extending in the waveguide, a first aperture being located in a broad wall of the waveguide and a second aperture being located in a narrow wall of the waveguide, characterized in that said first and second apertures are positioned within a prescribed phase relationship to the propagating electromagnetic field to provide a filter having reduced length along the same direction as the propagating electromagnetic field.

2. A waveguide filter in accordance with claim 1 wherein the plurality of resonators comprises first and second resonators respectively associated with the first and second apertures, each resonator (12, 13 or 31–36) is dielectric material having a shape of a cylindrical disc, said first resonator (11 or 31–33) having its cylindrical axis oriented parallel to the plane of the broad wall and perpendicular to the direction of the propagating electromagnetic field, and said second resonator (13 or 34–36) having its cylindrical axis parallel to the plane of the narrow wall and parallel to the direction of the propagating electromagnetic field.

3. A waveguide filter in accordance with claim 2 further comprising separate housing elements (17, 18 or 41–46) for individually surrounding the remaining substantial portion of each resonator located exterior to said waveguide.

4. A waveguide filter (FIG. 3) in accordance with claim 3 wherein each of said first and second resonators are symmetrically disposed about a common cross section of the waveguide.

5. A waveguide filter (FIG. 5) in accordance with claim 3 wherein said first and second resonators are longitudinally displaced.

6. A filter in accordance with claim 4 wherein said first and second resonators are essentially resonant at the same frequency to provide a bandstop filter characteristic.

7. A filter in accordance with claim 5 wherein said first and second resonators have different resonant frequencies serving to define a bandpass region between the resonant frequencies.

8. A filter according to claims 6 or 7 wherein each one of the housing elements includes frequency tuning means (26, 27 or 51–56) for tuning the resonant frequency of the dielectric resonator therein.

9. A filter according to claims 6 or 7 wherein said dielectric resonators are ceramic.

10. A filter according to claims 6 or 7 wherein said dielectric resonators are a barium titanate ($Ba_2Ti_9O_{20}$) ceramic.

11. A waveguide bandpass filter (FIGS. 5, 6) for passing a signal centered at frequency $f_c$ and rejecting signals at two frequencies, one above and the other below $f_c$ comprising a rectangular waveguide having two broad walls and two narrow walls forming a waveguide (37) and capable of propagating electromagnetic energy therethrough, first (31) and second (34) resonators located respectively in apertures in a broad wall and a narrow wall of the waveguide (37), each resonator symmetrically disposed about a first common cross sectional reference plane of the waveguide, said first resonator coupling to the electromagnetic field and resonant at one of the two frequencies, and said second resonator coupling to the electromagnetic field and resonant at the other one of the two frequencies.

12. A filter in accordance with claim 11 further comprising third (35) and fourth (33) resonators respectively located in apertures in a broad wall and a narrow wall of the waveguide, said third and fourth resonators each symmetrically disposed about a second common cross sectional reference plane at a predetermined distance from the first cross sectional resonance plane, said third resonator having a resonant frequency corresponding to that of said second resonator and said fourth resonator having a resonant frequency corresponding to that of said first resonator.

13. A filter in accordance with claim 12 further comprising fifth (32) and sixth (36) resonators one associated with an aperture in the narrow wall and the other associated with an aperture in the broad wall and one located between said first and second cross sectional reference planes and the other located at predetermined distance therefrom.

14. A filter in accordance with claim 13 wherein said fifth and sixth resonators are resonant at a common frequency to provide insertion loss for the filter at the common frequency.

15. A filter in accordance with claim 14 wherein the spacing between said first and third resonators having a common resonant frequency is a multiple of a $\frac{1}{2}\lambda_{gc}$, where $\lambda_{gc}$ is the wavelength at $f_c$.

16. A filter in accordance with claim 15 wherein selected ones of the resonators is centrally located about the longitudinal center line of the broad wall having its aperture.

17. A filter in accordance with claim 16 wherein said fifth and sixth resonators have a common resonant frequency $f_3$ and the spacing between them is a multiple of a $\frac{1}{2}\lambda_{g3}$ where $\lambda_{g3}$ is the wavelength at $f_3$.

* * * * *